US009187152B2

(12) United States Patent
Bailey et al.

(10) Patent No.: US 9,187,152 B2
(45) Date of Patent: Nov. 17, 2015

(54) SHALLOW WATER ANCHOR

(71) Applicants: David Bailey, Riverview, FL (US); Jantzen Maynard, Tampa, FL (US); John Oliverio, Tampa, FL (US); Amit Patel, Tampa, FL (US)

(72) Inventors: David Bailey, Riverview, FL (US); Jantzen Maynard, Tampa, FL (US); John Oliverio, Tampa, FL (US); Amit Patel, Tampa, FL (US)

( * ) Notice: Subject to any disclaimer, the term of this patent is extended or adjusted under 35 U.S.C. 154(b) by 190 days.

(21) Appl. No.: 13/986,742

(22) Filed: May 31, 2013

(65) Prior Publication Data

US 2014/0352597 A1 Dec. 4, 2014

(51) Int. Cl.
*B63B 21/26* (2006.01)

(52) U.S. Cl.
CPC ..... *B63B 21/26* (2013.01)

(58) Field of Classification Search
CPC ..... B63B 21/30
USPC ..... 440/36, 54, 58–60; 114/230.13
See application file for complete search history.

(56) References Cited

U.S. PATENT DOCUMENTS

| | | | | |
|---|---|---|---|---|
| 2,703,989 | A * | 3/1955 | Schroeder | 477/34 |
| 7,628,662 | B2 * | 12/2009 | Demastus | 440/36 |
| 8,661,999 | B2 * | 3/2014 | Blom | 114/230.13 |
| 2011/0209653 | A1 * | 9/2011 | Bernloehr et al. | 114/230.13 |

* cited by examiner

*Primary Examiner* — Edwin Swineheart

(57) ABSTRACT

A shallow water anchor to anchor a water craft in a shallow body of water comprising an anchor positioning assembly mounted on or to the water craft and an anchor member, the anchor position assembly comprises at least one anchor engaging member coupled to an anchor positioning device to raise and lower the anchor member between an elevated position and an anchored position and a system control to control the operation of the anchor position assembly in raising and lowering the anchor member such that the anchor member is lowered to engage the bottom of the shallow body of water to anchor the water craft and the anchor member disengages the bottom of the shallow body of water when the anchor member is raised to permit the water craft to move about the shallow body of water.

53 Claims, 8 Drawing Sheets

SHALLOW WATER ANCHOR

BACKGROUND OF THE INVENTION

1. Field of the Invention

A shallow water anchor to selectively anchor a water craft in a shallow body of water.

2. Description of the Prior Art

Fishing from a boat or other water craft in shallow water is common where there are extensive shallow, grassy-bottomed areas known as "flats". Conventional anchors and poles forced into the bottom are used to secure the boat in place.

Danforth or spud types used by flats fishermen has several shortcomings. Often the boat's position is not firmly fixed allowing the boat to drift at the end of the anchor line. In addition both setting and retrieving an anchor, the anchor's flukes tear sea grass from the bottom causing significant ecological damage. In addition, when the anchor is retrieved, mud and sea grass from the anchor often foul the inside of the boat.

Poles are often used to propel a boat through flats when attempting to approach fish without the sound of an engine. In some cases, the fisherman may provide some sort of pole-retaining hardware such as a vertically disposed pipe having two open ends and a diameter substantially greater than that of the pole may be fastened to the boat hull to hold the boat to the pole after the pole is thrust more or less vertically into the bottom. Such arrangements fix the position of the boat more securely and cause substantially less damage to sea grass beds than does anchoring. This approach is not widely used, as poling is slow and laborious, and the great majority of flats fishermen do not carry or use poles.

US 2013/0036961 discloses a shallow water anchoring device that attaches to the outside hull of a boat. The device drives a sharpened rod into the floor of the body of water. The device uses an electric motor to drive the driving wheel that drives the rod into the floor. The rod is housed within a tube that connects to the housing of the driving wheel.

U.S. Pat. No. 2,092,011 shows an anchoring device for watercraft comprising an extensible spud including a plurality of multiplicity of telescopically sections adapted for slidable movement through a well operating means including a rotatable pinion and means in connection with the spud including a longitudinally extending rack adapted to engage the pinion to move the spud through the spud well.

U.S. Pat. No. 7,628,662 relates to a motorized push pole device having a standard mounted to a raised poling platform on a boat. A housing is mounted to the standard removably clamp around a push pole. A drive wheel is mounted under the housing in contact with the push pole to rotate in a first direction causing push pole to move in an extendable motion and to rotate in the opposite direction causing push pole to move in a retractable motion. An electrical switch is connected to a motor for controlling operation of the motor for rotating the drive wheel. The motor includes a rotating motor shaft terminating in a worm gear. The drive wheel further comprising a cog wheel for engaging the worm gear of the motor.

U.S. Pat. No. 7,921,794 describes a rod-shaped anchor and collar to slidably receive the anchor. A drive mechanisms selectively raises and lowers the anchor.

U.S. Pat. No. 16,704 discloses a device for pushing boats through the water comprising a pole or rod and piston combination.

U.S. Pat. No. 4,702,047 relates to an anchor comprising a first part engageable within an anchoring medium ground along an insertion axis; a second part to which loads are attached; and linking means interconnecting the first and second parts while permitting displacement of the second part relating to the insertion axis so that when a load is applied to the second part after the first part has been inserted into the anchoring medium the second part can alter position without moving the first part thus reducing the effective loading on the first part.

U.S. Pat. No. 4,960,064 teaches a land anchor comprising a hammer element that permits the anchor to be driven into the soil including a stabilizing assembly that increases the anchoring force of the anchor for loose soils. The stabilizing assembly includes a wing section that is expanded from a stored, ground-entering configuration to a ground-gripping configuration by operation of a screw extending within a central rod of the anchor.

U.S. Pat. No. 1,122,401 is an additional example of the prior art.

While various elements, in part, similar to some components of the instant invention are known, the combination of structural elements are neither thought nor suggested.

SUMMARY OF THE INVENTION

The present invention relates to a shallow water anchor mounted on or in a water craft for use in a body of shallow water comprising an anchor positioning assembly at least partially disposed within an housing, an anchor member and a system control.

The anchor positioning assembly comprises at least one anchor engaging member coupled to an anchor positioning device or drive mechanism to cooperatively raise and lower the anchor member vertically between an elevated or raised position and an extended or anchored position. The anchor engaging member comprises a disk or wheel to operatively engage the anchor member; while, the anchor positioning device or drive mechanism comprises a reversible motor. The disk or wheel coupled to the reversible motor is controlled by a system control operatively coupled to a power source to selectively raise and lower the anchor member.

The water craft may be powered about the shallow body of water by a motor with the anchor member in the elevated or raised position. When the water craft is located in a desired location, the anchor member is then lowered by the system control causing the reversible motor to rotate the disk or wheel to lower the anchoring element downward until the anchor member engages the bottom of the small body of water to anchor the water craft.

When the operator decides to move the water craft, the direction of the reversible motor is reversed rotating the disk or wheel in the opposite direction to raise the anchor member vertically upward from the extended or anchored position disengaging the lower portion of the anchor member from the bottom of the shallow body of water allowing the water craft to move about.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
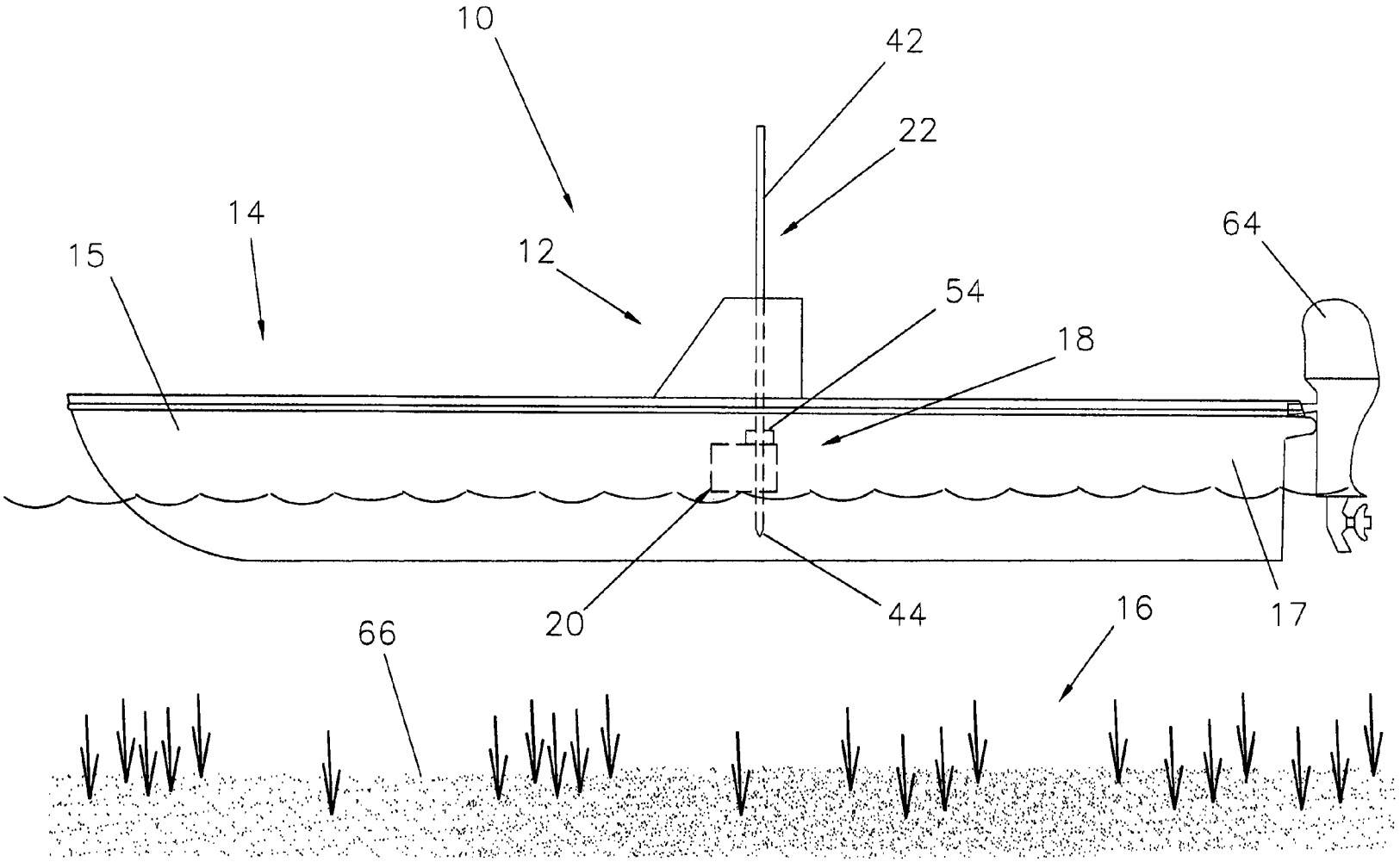
FIG. 1 is a side view of the shallow water anchor of the present invention with the anchor member in the elevated or raised position such that the anchor member is disengaged from the bottom of the shallow body of water.

As shown in FIGS. 1 through 4, the present invention relates to a shallow water anchor generally indicated as 10 mounted on a console generally indicated as 12 located midship of a water craft generally indicated as 14 for use in a shallow body of water 16.

The shallow water anchor 10 and console 12 may be located at the bow 15 or the stern 17 or both at the bow 15 and the stern 17. Alternatively, the water anchor 10 and console 12 may be located on the starboard or port side of the water craft 14.

The shallow water anchor 10 comprises an anchor positioning assembly generally indicated as 18 partially disposed within an housing generally indicated as 20 including housing walls 21 and a substantially vertical anchor member generally indicated as 22.

Figure 2:
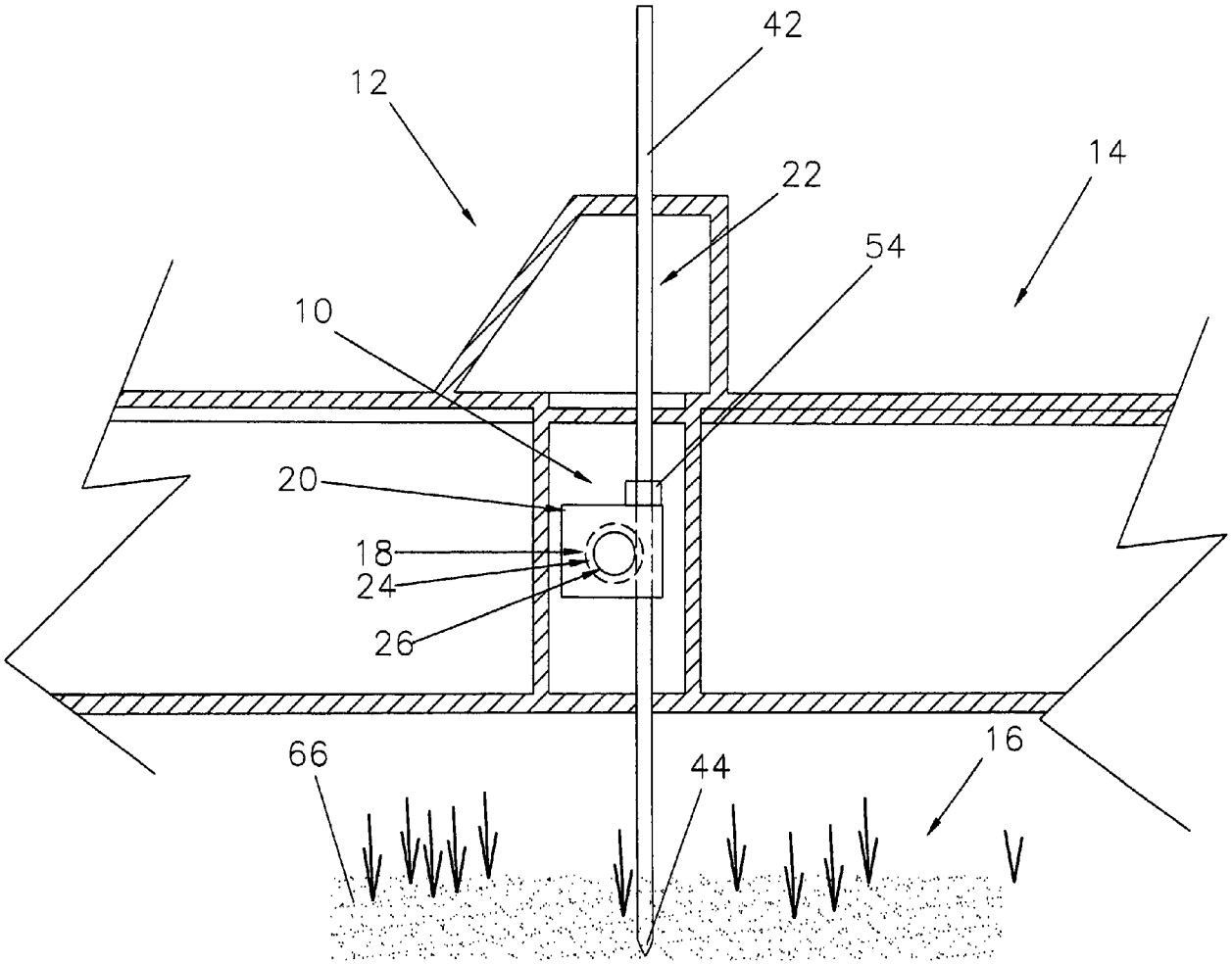
FIG. 2 is a cross-sectional side view of the shallow water anchor of the present invention with the anchor member in the second or lowered position such that the anchor member engages the bottom of the shallow body of water.
Figure 4:
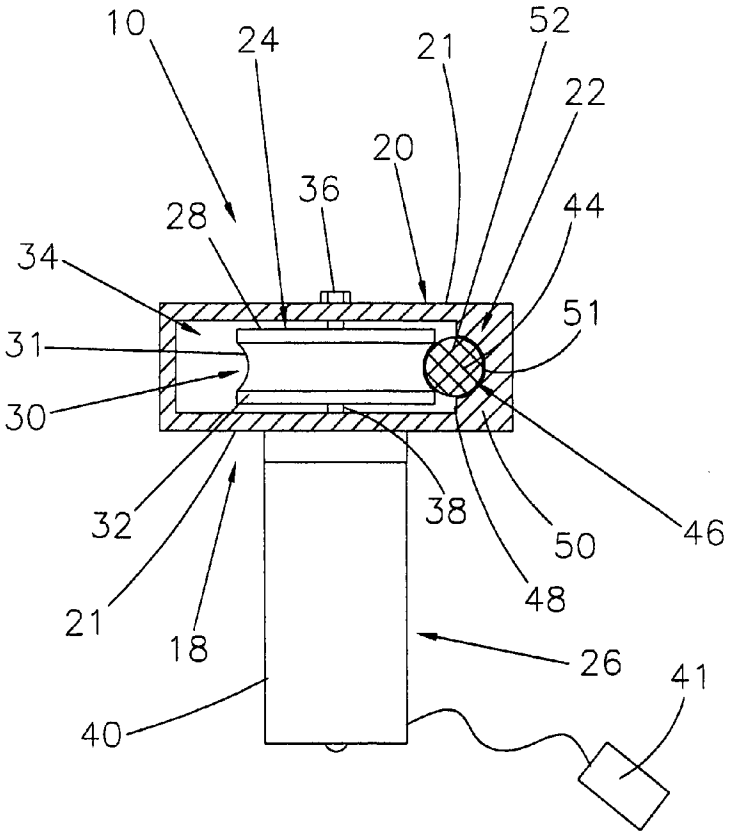
FIG. 4 is a partial cross-sectional top view of the shallow water anchor of the present invention.
Figure 3:
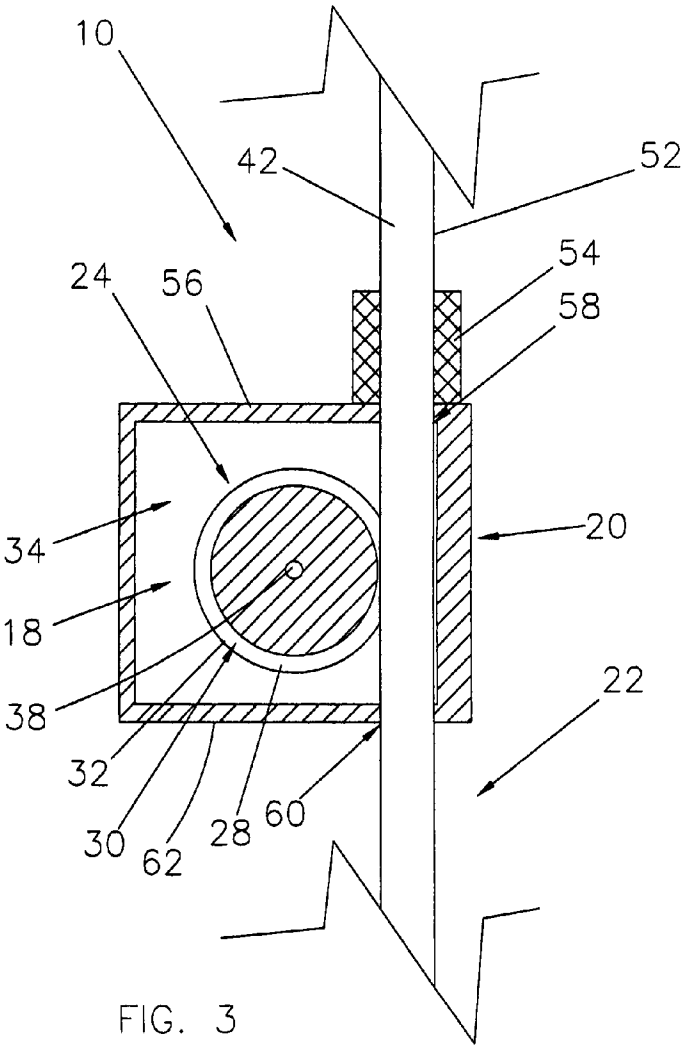
FIG. 3 is a partial cross-sectional side view of the shallow water anchor of the present invention.

As shown in FIGS. 2 through 4, the anchor positioning assembly 18 comprises an anchor engaging member generally indicated as 24 coupled to an anchor positioning device or drive mechanism generally indicated as 26 to raise and lower the substantially vertical anchor member 22 between an elevated or raised position (FIG. 1) and an extended or anchored position (FIG. 2).

As shown in FIGS. 3 and 4, the anchor engaging member 24 comprises a substantially vertical disk or wheel 28 having a concave groove 30 including a concave inner surface 31 formed in the peripheral edge or circumference 32 thereof to operatively engage the outer surface 52 of the anchor member 22. The substantially vertical disk or wheel 28 is rotatably disposed within a cavity 34 of the housing 20 by a pin or mounting member 36 and a drive shaft 38 extending outwardly from a reversible motor 40 which together form the anchor positioning device 26. The drive shaft 38 of the reversible motor 40 may extend through opposite housing walls 21 to support the substantially vertical disk or wheel 28 without the pin or mounting member 36. The reversible motor 40 is operatively coupled to a control device 41 and a power source such as a marine battery (not shown). A resilient tread similar to that shown in FIG. 11 may be disposed in the concave groove 30 to operatively engage the outer surface 52 of the anchor member 22. As described hereinafter with respect to an alternate embodiment, the groove 30 may comprise a rectilinear groove or configuration with a substantially flat inner surface.

As best shown in FIGS. 1 and 2, the anchor member 22 comprises an upper substantially cylindrical elongated element 42 terminating in a lower substantially conically shaped anchoring element 44 that cooperatively form a spike.

The shallow water anchor 10 may further comprise an anchor alignment to engage the outer surface 52 of the upper substantially cylindrical elongated element 42 of the anchor member 22 to maintain the anchor member 22 in the substantially vertical position. As shown in FIG. 4, the anchor alignment comprises a substantially vertical groove 46 formed on the inner surface 48 of an end wall 50 of the housing 20 that includes a concave surface 51 adjacent the concave surface 31 of the substantially vertical disk or wheel 28 of the anchor engaging member 24 such that the outer surface 52 of the upper substantially cylindrical elongated element 42 of the anchor member 22 engages the concave surface 31 and the concave surface 51 to maintain the substantially vertically disposed anchor member 22 in the substantially vertical position.

As shown in FIGS. 1 through 3, a secondary or upper anchor alignment comprising a hollow sleeve 54 coaxially aligned with the geometric center cooperatively formed between the concave surface 31 of the substantially vertical disk or wheel 28 and the concave surface 51 of the end wall 50 of the housing 20 and disposed on the top wall 56 of the housing 20 in vertical alignment with an upper housing aperture 58 and a lower housing aperture 60 formed through the top wall 56 and a bottom wall 62 of the housing 20 respectively to receive the upper substantially cylindrical elongated element 42 of the anchor member 22 to further maintain the anchor member 22 in the substantially vertical position.

When assembled, the anchor member 22 extends vertically through the hollow sleeve 54 and the upper housing aperture 58, engaging both the concave surface 31 and concave surface 51 and through the lower housing aperture 60.

The water craft 14 is intended to be powered about the shallow body of water 16 by a motor 64 with the anchor member 22 in the elevated or retracted position (FIG. 1). When the water craft 14 is positioned in a desired location, the anchor member 22 is then lowered by the reversible motor 40 using the control device 41 causing the substantially vertical disk or wheel 28 to lower the anchoring element 22 downward to the extended or anchored position (FIG. 2) such that the lower substantially conically shaped anchoring element or tip 44 engages the bottom 66 of the shallow body of water 16.

When the operator decides to move the water craft 14, the substantially vertical disk or wheel 28 raises the anchor member 22 to an intermediate position or to the fully elevated or raised position (FIG. 1) by operating the reversible motor 40 in the opposite or reverse direction.

Figures 5, 6:
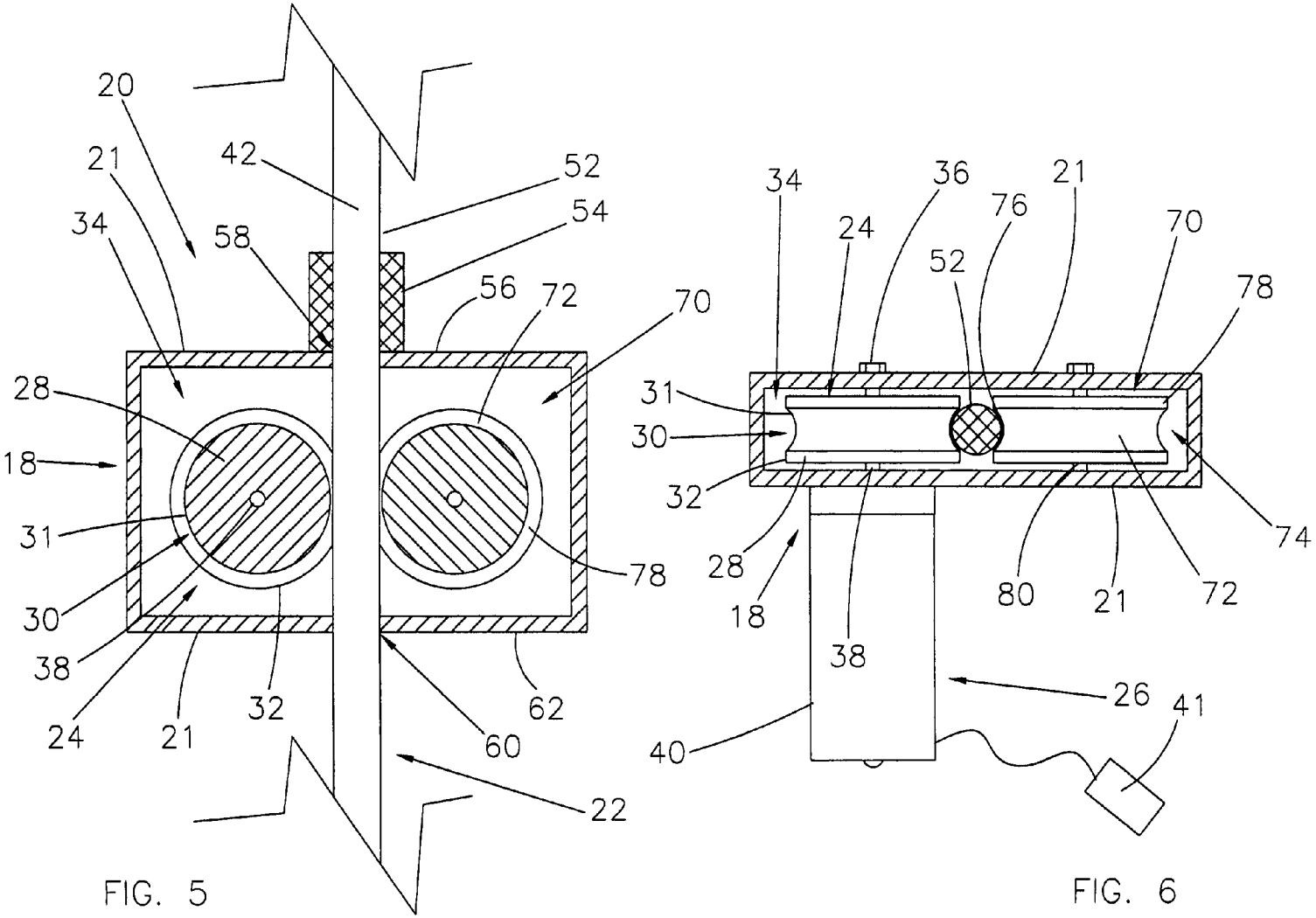
FIG. 5 is a partial cross-sectional side view of an alternate embodiment of the shallow water anchor of the present invention.
FIG. 6 is a partial cross-sectional top view of the alternate embodiment of the shallow water anchor of the present invention shown in FIG. 5.

FIGS. 5 and 6 disclose an alternate embodiment of the shallow water anchor 10 with similar structural elements similarly designated. Specifically, the anchor positioning assembly 18 comprises an anchor engaging member generally indicated as 24 coupled to an anchor positioning device or drive mechanism generally indicated as 26 to cooperatively raise and lower the substantially vertical anchor member 22 between an elevated or raised position (FIG. 1) and an extended or anchored position (FIG. 2).

As shown in FIGS. 5 and 6, the anchor engaging member 24 comprises a substantially vertical disk or wheel 28 having a concave groove 30 including a concave surface 31 formed in the peripheral edge or circumference 32 thereof to operatively engage the outer surface of the anchor member 22. The substantially vertical disk or wheel 28 is rotatably disposed within a cavity 34 of the housing 20 by a pin or mounting member 36 and a drive shaft 38 extending outwardly from a reversible motor 40 which together form the anchor positioning device 26. The drive shaft 38 of the reversible motor 40 may extend through opposite housing walls 21 to support the substantially vertical disk or wheel 28 without the pin or mounting member 36. The reversible motor 40 is operatively coupled to a control device 41 and coupled to a power source such as a marine battery (not shown). A resilient tread similar to that shown in FIG. 11 may be disposed in the concave groove 30 to operatively engage the outer surface 52 of the anchor member 22. As described hereinafter with respect to an alternate embodiment, the groove 30 may comprise a rectilinear groove or configuration with a substantially flat surface.

The anchor member 22 comprises an upper substantially cylindrical shaped elongated element 42 terminating in a lower substantially conically shaped anchoring element or tip 44 as shown in FIGS. 1 and 2.

The shallow water anchor 10 may further comprise an anchor alignment to engage the outer surface 52 of the upper substantially cylindrical elongated element of the anchor member 22 to maintain the anchor member 22 in the substantially vertical position. As shown in FIG. 6, the anchor alignment generally indicated as 70 comprises a substantially vertical disk or wheel 72 having a concave groove 74 including a concave surface 76 formed in the peripheral edge or circumference 78 thereof to operatively engage the outer surface 52 of the anchor member 22 opposite the outer surface 52 of the anchor member 22 engaged by the concave surface 31 of the concave groove 30 of the substantially vertical disk or wheel 28 of the anchor engaging member 24. The substantially vertical disk or wheel 72 is rotatably disposed within the cavity 34 of the housing 20 by a shaft or mounting member 80.

As shown in FIG. 5, a secondary or upper anchor alignment comprising a hollow sleeve 54 coaxially aligned with the geometric center cooperatively formed between the concave surface 31 of the substantially vertical disk or wheel 28 and the concave surface 76 of the substantially vertical disk or wheel 72 and disposed on the top wall 56 of the housing 20 in vertical alignment with an upper housing aperture 58 and a lower housing aperture 60 formed through the top wall 56 and a bottom wall 62 of the housing 20 respectively to receive the upper substantially cylindrical elongated element 42 of the anchor member 22 to further maintain the anchor element 22 in the substantially vertical position.

When assembled, the anchor member 22 extends vertically through the hollow sleeve 54 and the upper housing aperture 58, engaging both the concave surface 31 and the concave surface 76 and through the lower housing aperture 60.

The water craft 14 and shallow water anchor 10 are operated similarly to the shallow water anchor 10 described with reference to FIGS. 1 through 4.

Figure 8:
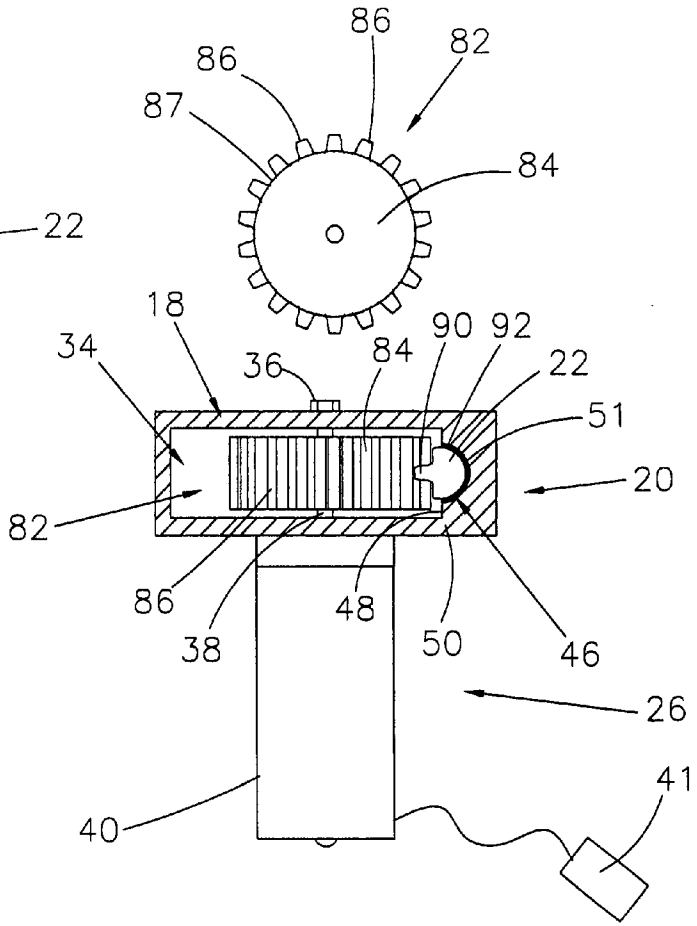
FIG. 8 is a partial cross-sectional top view of the alternate embodiment of the shallow water anchor of the present invention shown in FIG. 7.
Figure 7:
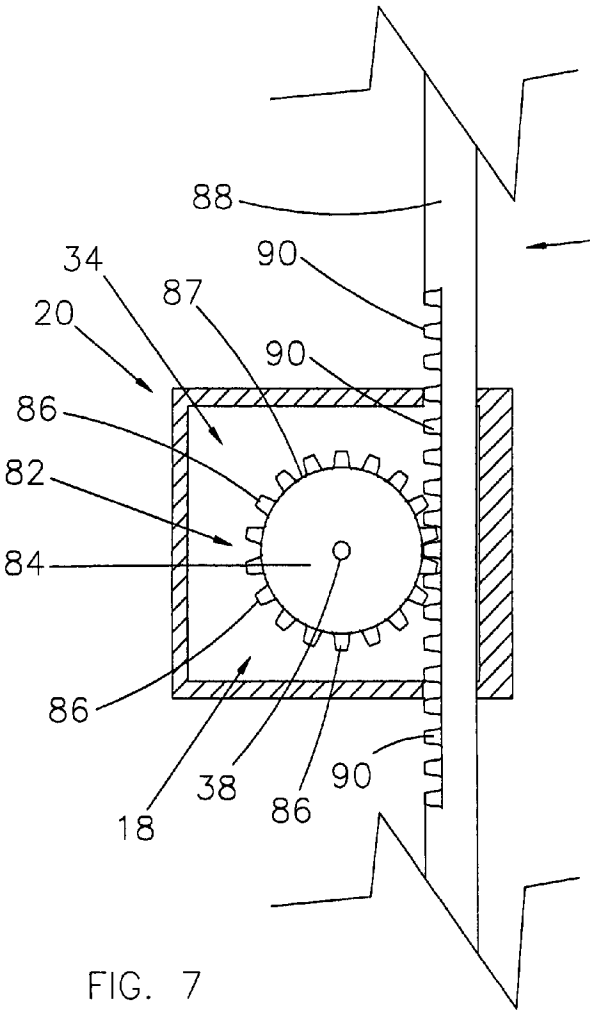
FIG. 7 is a partial cross-sectional side view of another alternate embodiment of the shallow water anchor member of the present invention.

FIGS. 7 and 8 disclose another alternate embodiment of the shallow water anchor 10 with similar structural elements similarly designated. In particular, the anchor positioning assembly 18 comprises an anchor engaging member generally indicated as 82 coupled to an anchor positioning device or drive mechanism generally indicated as 26 to cooperatively raise and lower the anchor member 22 between the elevated or raised position (FIG. 1) and the extended or anchored position (FIG. 2).

The anchor engaging member 82 comprises a substantially vertical disk or wheel 84 having a plurality of teeth or projections each indicated as 86 formed on the peripheral edge or circumference 87 thereof to operatively engage a plurality of teeth or projections each indicated as 90 formed on the outer surface 88 of the anchor member 22. The substantially vertical disk or wheel 84 is rotatably disposed within the cavity 34 of the housing 20 by a pin or mounting member 36 and a drive shaft 38 extending outwardly from a reversible motor 40 which together form the anchor positioning device or drive mechanism 26. The drive shaft 38 may extend through opposite housing walls 21 to support the substantially vertical disk or wheel 28 without the pin or mounting member 36. The reversible motor 40 is operatively coupled to a control device 41 is operatively coupled to a power source such as a marine battery (not shown).

The anchor member 22 comprises an upper substantially cylindrical elongated element 42 terminating in a lower substantially conically shaped anchoring element or tip 44.

The shallow water anchor 10 may further comprise an anchor alignment to engage the convex outer surface 92 of the anchor member 22 opposite the plurality of teeth or projections 90 to maintain the anchor member 22 in the substantially vertical position. As shown in FIG. 8, the anchor alignment comprises a substantially vertical groove 46 formed on the inner surface 48 of an end wall 50 of the housing 20 that includes a concave surface 51 adjacent the convex outer surface 92 of the anchor member 22.

This embodiment is similarly assembled and operated as the two previously described embodiments.

FIGS. 9 through 12 depict yet another embodiment of shallow water anchor generally indicated as 110 operable in a manual mode or an automatic mode (auto-mode) mounted on or to the water craft 14 for use in the shallow body of water 16 as shown in FIGS. 1 and 2.

Figure 12:
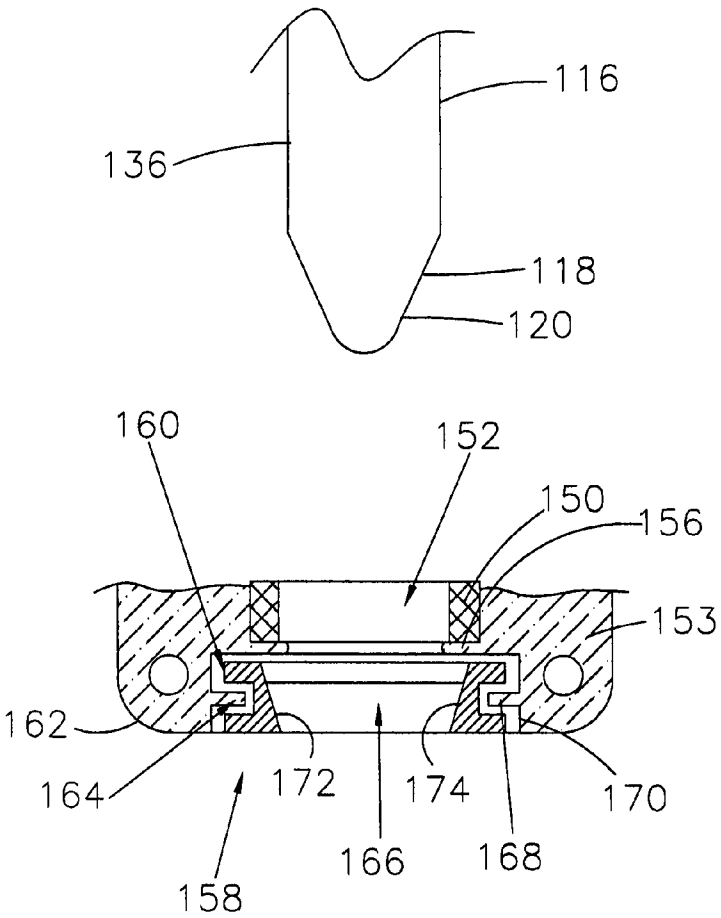
FIG. 12 is a partial cross-sectional view of the lower portion of the housing and directional disk of the alternate embodiment of the shallow water anchor of the present invention shown in FIG. 9.

The shallow water anchor 110 comprises an anchor positioning assembly disposed within a housing including a lower housing portion 112 and an upper housing portion 114 and an anchor member including an upper substantially cylindrical elongated portion 116 and a lower substantially conically shaped portion 118 terminating in a blunt convex tip 120 to cooperatively form a spike (FIG. 12).

Figure 10:
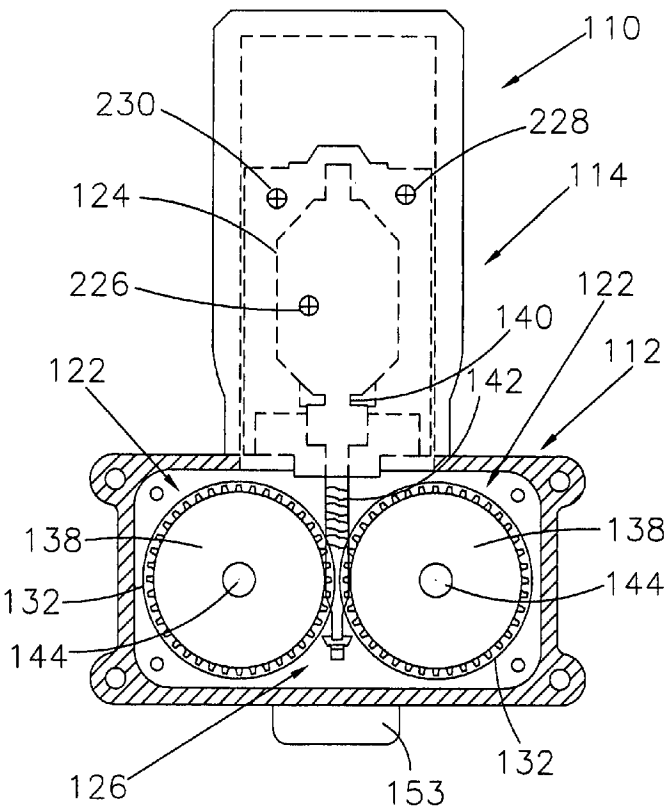
FIG. 10 is a partial cross-sectional rear view of the alternate embodiment of the shallow water anchor of the present invention shown in FIG. 9.
Figure 9:
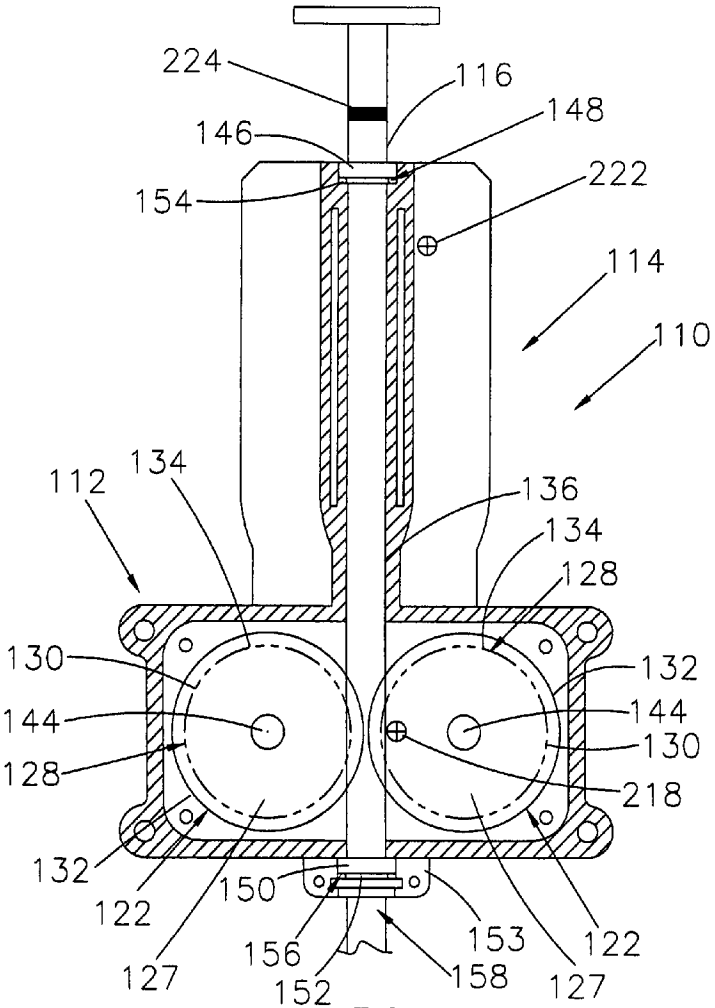
FIG. 9 is a partial cross-sectional front view of yet another alternate embodiment of the shallow water anchor of the present invention.
Figure 11:
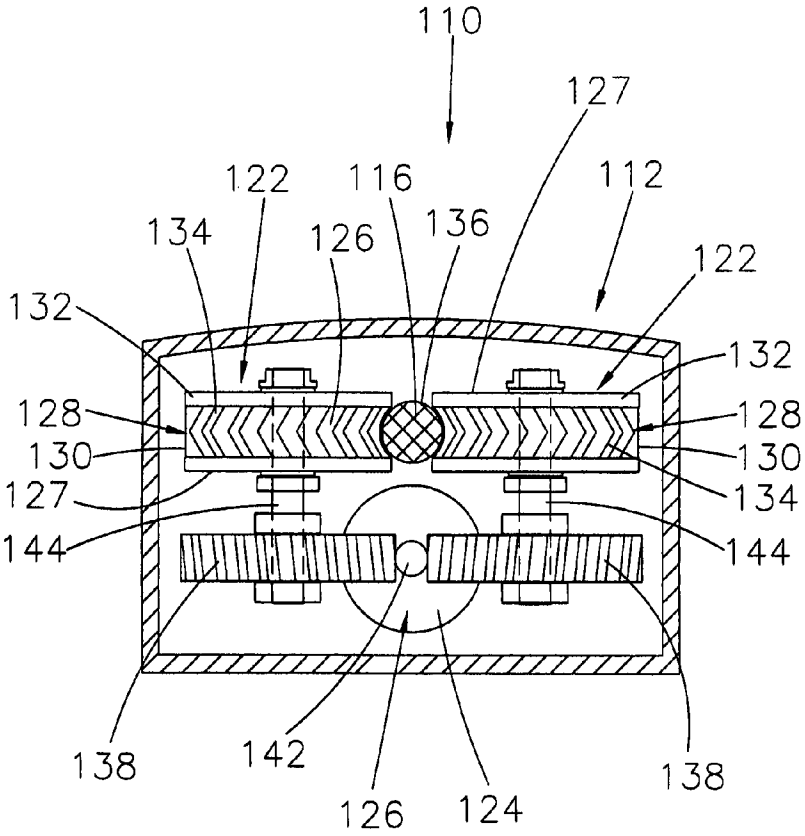
FIG. 11 is a partial cross-sectional top view of the alternate embodiment of the shallow water anchor of the present invention shown in FIG. 9.

As shown in FIGS. 9 through 11, the anchor positioning assembly comprises an anchor engaging assembly including a pair of counter-rotating anchor engaging members each generally indicated as 122 rotatably disposed within the lower housing portion 112 and operatively coupled to an anchor positioning drive mechanism including a reversible motor 124 disposed within the upper housing portion 114 and a gear drive assembly generally indicated as 126 disposed within the lower housing portion 112 to cooperatively raise and lower the anchor member between the elevated or raised position (FIG. 1) and an extended or anchored position (FIG. 2).

As shown in FIGS. 9 and 11, each anchor engaging member 122 comprises a substantially vertical disk or wheel 127 having a rectilinear groove 128 including a flat inner surface 130 formed in the peripheral edge or circumference 132 thereof. A resilient tread 134 including a V-shaped design is disposed in each rectilinear groove 128 to operatively engage the outer surface 136 of the anchor member.

The horizontal distance between the resilient treads 134 aligned with the vertically disposed anchor member is less than the diameter of the upper substantially cylindrical elongated portion 116 to grasp or squeeze the anchor member therebetween. Alternately, the anchor member can be constructed of compressible material to be grasped or squeezed between the flat inner surface 130.

As shown in FIGS. 10 and 11, the gear drive assembly 126 of the anchored position drive mechanism comprises a pair of substantially vertical counter-rotating drive gears each indicated as 138 disposed in operative engagement with a worm gear 142 coupled to the output shaft 140 of the reversible motor 124.

Each substantially vertical counter-rotating disk or wheel 126 and corresponding substantially vertical counter-rotating drive gear 138 is rotatably disposed within the lower housing portion 112 by a mounting member or shaft 144.

As shown in FIGS. 9 and 12, a disk or donut-like upper anchor member guide 146 including a guide hole 148 formed therethrough and a disk or a donut-like lower anchor member guide 150 including a guide hole 152 formed therethrough are mounted to or supported within the upper housing portion 114 and a lower housing extension 153 formed on the lower end of the lower housing portion 112 respectively by an upper guide support 154 and a lower guide support 156 respectively. Since the anchor member extends through the coaxially aligned guide holes 148 and 152, the outer surface 136 of the anchor member engages the inner surface of the disk or donut-like upper anchor member guide 146 and the disk or donut-like lower anchor member guide 150 to maintain vertical alignment or disposition of the anchor member.

As shown in FIG. 12, a free floating disk squeegee or wiper member generally indicated as 158 is movably disposed within a substantially circular or cylindrical recess 160 formed in the bottom 162 of lower housing extension 153 of the lower housing portion 112 to wipe the outer surface 136 of the anchor member during the raising and lowering thereof. In particular, the free floating disk squeegee or wiper member 158 includes a substantially horizontal circular groove 164 formed on the outer vertical surface thereof and an inverted frustum conical hole 166 formed through the center thereof aligned with the guide hole 148 formed through the upper disk or donut-like anchor member guide 146 and the guide hole 152 formed through the lower disk or donut-like anchor member guide 150 to receive the anchor member therethrough. The diameter of the lower circumference 172 of the inverted frustum conical hole 170 is slightly greater than the diameter of the upper substantially cylindrical elongated portion 116 of the anchor member; while, the diameter of the upper circumference 174 of the inverted frustum conical hole 166 is greater than that of the diameter of the guide hole 152 of the disk or donut-like lower anchor member guide 150. The substantially circular or cylindrical recess 160 includes a substantially horizontal flange or retainer lip 168 extending inwardly from the mid-portion of the inner substantially surface 170 of the substantially circular or cylindrical recess 160 into the substantially horizontal circular groove 164 of the free floating disk squeegee or wiper member 158 to support the free floating squeegee or wiper member 158 at least partially within the substantially circular or cylindrical recess 168.

Figure 13:
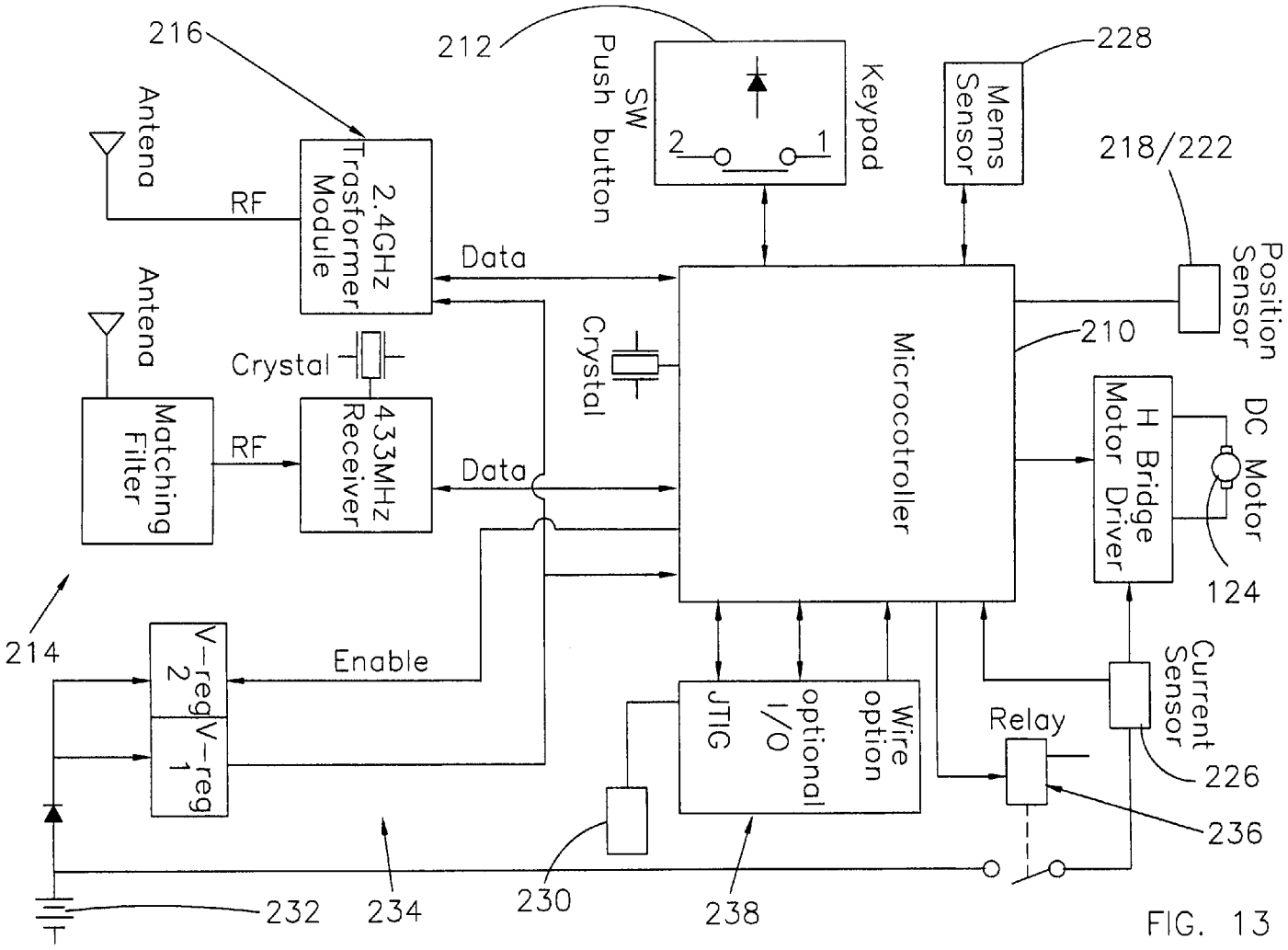
FIG. 13 is a block diagram of the system control of the shallow water anchor of the present invention.

As shown in FIG. 13, the system control comprises a system control circuit including a microcontroller 210 with a microprocessor and operator or external system controls such as a keypad 212, a receiver 214, a transceiver 216 and the hand control 41 (FIGS. 6 and 8), an upper and lower anchor position sensor assembly including an upper anchor member position sensor 218 coupled to the microcontroller 210 (FIG. 9) and an upper anchor member position sensing element 220 such as a magnet or reflective element (FIG. 12), and a lower anchor member position sensor 222 (FIG. 9) coupled to the microcontroller 210 and a lower anchor member position sensing element 224 such as a magnet or reflective element (FIG. 9) respectively, and a current sensor 226 (FIG. 13) coupled between the reversible motor 124 and the microcontroller 210, and a nine-axis micro-electromechanical sensor (MEMS) 228 (FIG. 13) including a 3-axis accelerometer, a 3-axis magnetometer and a 3-axis gyroscope coupled to the microcontroller 210, and a global position system (GPS) sensor 230 (FIG. 10) coupled to the microcontroller 210 through port 238.

A first or elevated sensor signal is transmitted to the microcontroller 210 by the upper anchor member position sensor 218 when the upper anchor member position sensor 218 and the upper anchor member position sensing element 220 are substantially aligned in the horizontal plane or in proximity relative to each other to stop the reversible motor 124 when the anchor member 116 is in the elevated or raised position. A second or extended sensor signal is transmitted to the microcontroller 210 by the lower anchor member position sensor 222 when the lower anchor member position sensor 222 and the lower anchor member position sensing element 224 are substantially aligned in the horizontal plane or in proximity relative to each other to stop the reversible motor 124 when the anchor member 116 is in the lower most position whether or not anchored.

The current sensor 226 monitors motor current of the reversible motor 124 to generate a first current signal fed to the microcontroller 210 when the blunt convex tip 120 of the lower substantially conically shaped portion 118 of the substantially vertical anchor member 116 engages the bottom 66 of the shallow body of water 16 to stop the reversible motor 124 to anchor the water craft 14 in position.

In addition, the current sensor 226 monitors motor current to generate a second current signal fed to the microcontroller 210 when the blunt convex anchor tip 120 of the lower substantially conical shaped portion 118 of the substantially vertical anchor member 116 passes through the counter-rotating anchor engaging members 122 traveling upward when the reversible motor 124 is operating to raise the anchor member 118 to the reverse direction of the reversible motor 124 to lower the substantially vertical anchor member 116 until the first upper anchor member position sensor 218 and the second upper anchor member position sensing element 220 are substantially aligned in the horizontal plane or in proximity relative to each other to stop the reversible motor 124 with the anchor member in the elevated or raised position as shown in FIG. 1.

When the shallow water anchor 110 is operating in the auto-mode, the micro-electromechanical systems (MEMS) sensor 228 feeds acceleration, gyroscopic, and magnetometer signals to the microcontroller 210 for power management, deployment control, bottom sensing and holding operation to maintain the anchor in the anchored position (FIG. 2) when deployed.

Specifically, when the accelerometer, magnetometer or gyroscope of the MEMS sensor 228 or the GPS sensor 230 coupled through port 238 senses a change in attitude, orientation or position of the water craft 14 a signal will be fed to the microcontroller 210 which, in turn, generates an auto down signal fed to the reversible motor 124 to power or move the anchor member down to reestablish the anchored position. If the anchor member remained anchored, then the current sensor 226 will signal the microcontroller 210 to shut down the reversible motor 124.

The microprocessor of the microcontroller 210 calculates current measurements as well as the use of the proximity sensor signals for multiple parameter calculation techniques of pole position determinations as previously noted. All motion commands include speed information that controls the PWM signals from the microcontroller 210 to the reversible motor 124.

In addition, motor controllers can use timed sensor measurements to determine when the anchor is elevated and extended or is securely anchored to the bottom 66 of the shallow body of water 16 to feed stabilizing command signals fed from the MEMS sensor 228 and the GPS sensor 230 through port 238 to the microcontroller 210.

The anchor pole electronic system controls provide DC motor operation and wireless interconnection of system devices. UP and DOWN anchor controls are initiated by user inputs from switches local 41 or remote RF connected devices. Manual or Auto modes of operation are determined by the remote devices and updated commands are sent to the microcontroller 210 to operate and control the motor controller(s).

Manual UP and DOWN drives the motor(s) for a minimum time upon receiving a command. Remote sends updated manual commands repeatedly during activation. The auto extend or retract mode is entered by the remote detecting a double switch sequence.

The reversible motor 124 and system control are powered from a marine type direct current (DC) battery 232. The marine type DC battery 232 supplies direct current power to analog, digital and communication circuitry through a steering diode and voltage regulators 234. Power is managed using an electromechanical relay 236 operated by the microcontroller 210. This power arrangement provides reverse polarity protection and minimizes connection sparking. The keypad switches 212 and LEDs are incorporated for human interface to operate the motor drive and to indicate status. JTAG and optional I/O ports 238 are incorporated to load the program memory and to provide alternate connections such as USB, CAN, GPS (NEMA) along with individual inputs and outputs. The reversible motor 124 is controlled by signals generated by the microcontroller 210 in response to the previously described control signals and supplied to the reversible motor 124 with high current pulse width modulated (PWM) controlled full H-bridge drivers. The motor current sensor 226 provides instantaneous current measurement to the microcontroller 210 for operational control. The microcontroller 210 may employ a crystal (8 MHz) oscillator and internal low frequency (32 KHz) RC internal oscillators to generate trimming for timed digital and poser managed operation. An UHF (433 MHz) receiver is incorporated to provide low power short range remote control. The UHF receiver is powered by one of the voltage regulators with power management enabled control and is connected to the antenna with a frequency selective matching network. The UHF receiver data line is connected to the microcontroller 210 to decode the baseband data. The 2.4 GHz transceiver module 216 is included to provide cell telephone and internet connectivity with Bluetooth and/or Wi-Fi. The 2.4 GHz transceiver module 216 communicates with the microcontroller 210 using serial data connections.

The shallow water anchor 110 may be reversed to a fully retracted or elevated by reversing the motor divers to secure shallow water anchor 110 in a predetermined position relative to the counter-rotating anchor engaging members 122 of the anchor positioning assembly as previously described. The electromechanical control system is capable of employing time, current or position sensor measurements to determine when the secure shallow water anchor 110 is the elevated or raised position as shown in FIG. 1. Extreme low power hibernation may be entered using timing and lack of movement measured with or sensed by the MEMS sensor 228. Commands or movement may wake the microcontroller 210 from hibernation and prepare for normal operation. The MEMS sensor 228 and GPS sensor 230 allow the anchor pole system to maintain the water craft 14 anchored position by operating the reversible motor 124 to raise or lower the anchor 110 independent of operator input.

To summarize, in operation the user actuates the reversible motor 124 using the control 41, key pad 212 or remote wireless control to move or extend the anchor member downward until the blunt convex tip 120 of the lower substantially conical shaped port 118 of the substantially vertical cylindrical anchor member 116 engages the bottom 66 of the shallow body of water 16 causing the current through the reversible motor 124 to change with respect to time such that the current sensor 226 to feed a control signal to the microcontroller 210 to stop the reversible motor 124 to anchor the water craft 14 in position. Alternatively, the control signal can be fed directly to the reversible motor 124.

If the anchor member 116 reaches the fully extended position before touching the bottom 66, the lower anchor member position sensing element 224 of the lower anchor position sensor assembly is substantially aligned in the horizontal plane or in proximity to the lower anchor member positioning sensor 222 to generate a second or extended sensor signal fed to the microcontroller 210 to shut off the reversible motor 124. Alternatively, the control signal can be fed directly to the reversible motor 124.

The operator can raise the anchor member 116 vertically partially or to the fully elevated or raised position in order to move the water craft 14 through the use of the control 41, key pad 212 or remote wireless control. When the anchor member 116 reaches the fully elevated or raised position, the upper anchor member position sensing element 220 of the upper anchor position sensor assembly will be substantially aligned in the horizontal plane or in proximity to the upper anchor member position sensor 218 to generate a control signal fed to the microcontroller 210 or to the reversible motor 124 directly to shut off the reversible motor 124.

Alternately, as the anchor member is raised or elevated, the current sensor 230 will sense to the anchor member 116 not grasped or clasped between the resilient treads 134 to generate a control signal fed to the microcontroller 210 or directly to the reversible motor 124 to reverse the direction of the reversible motor 124 moving the anchor member 116 downward until the upper anchor position sensor assembly is aligned to shut off the reversible motor 124.

Once anchored, any movement of the water craft 14 will be sensed by the GPS sensor 230 coupled through port 238 or the MEMS sensor 228 will generate a signal fed to the microcontroller 210 which, in turn, will feed an auto-down signal to the reversible motor 124 to reestablish an anchored position by moving the anchor member downward until the anchor member touches the bottom 66. If the water craft 14 has not lost anchor, the current sensed will cause the reversible motor 124 to shut off.

The inverted frustum conical hole 166 of the free floating disk squeegee or wiper 158 receives the anchor member 116 when moving downward centering the free floating disk squeegee of wiper 158 within the substantially circular or cylindrical recess 160 in alignment with guide holes 148 and 152 of the upper disk or donut-like anchor member guide 146 and the lower disk or donut-like anchor member guide 150 such that the lower circumference of the inverted frustum conical hole 170 engages the outer surface of the upper substantially cylindrical elongated portion 116 of the anchor member to wipe the outer surface clean when raising or retracting the anchor member.

Although the use of a single shallow water anchor 10 is described, two or more shallow water anchors 10 may be used in tandem or laterally disposed.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A shallow water anchor to anchor a water craft in a shallow body of water comprising an anchor positioning assembly mounted on or to the water craft and an anchor member including an outer surface, said anchor positioning assembly comprises an anchor engaging assembly including a pair of counter-rotating anchor engaging members rotatably coupled to an anchor positioning device or drive mechanism including a reversible motor and a gear drive assembly comprising a substantially vertical counter-rotating drive gear operatively coupled to said reversible motor and said counter-rotating anchor engaging members to cooperatively raise and lower said anchor member such that said anchor member is lowered to engage the bottom of the shallow body of water to anchor the water craft and said anchor member is raised to disengage the bottom of the shallow body of water to permit the water craft to move about the shallow body of water said gear drive assembly.

2. The shallow water anchor of claim 1 wherein said anchor engaging member comprises a substantially vertical disk including a groove having an inner surface formed in a peripheral edge or circumference thereof to operatively engage said outer surface of said anchor member.

3. The shallow water anchor of claim 2 wherein said anchor positioning device or drive mechanism comprises a reversible motor coupled to said substantially vertical disk to selectively rotate said substantially vertical disk in clockwise or counter-clockwise direction to selectively raise and lower said anchor member.

4. The shallow water anchor of claim 3 wherein said reversible motor is operatively coupled to a control device to selectively control direction of rotation of said reversible motor to raise and lower said anchor member.

5. The shallow water anchor of claim 2 further including a resilient tread disposed in said groove to operatively engage said outer surface of said anchor member.

6. The shallow water anchor of claim 2 wherein said groove comprises a rectilinear configuration including a substantially inner flat surface to engage said outer surface of said anchor member.

7. The shallow water anchor of claim 2 wherein said groove comprises a substantially arcuate configuration including a substantially concave inner surface to engage said outer surface of said anchor member.

8. The shallow water anchor of claim 2 wherein said anchor member comprises an upper elongated element including an outer surface.

9. The shallow water anchor of claim 8 further comprising an anchor alignment to engage said outer surface of said upper elongated element of said anchor member to maintain said anchor member in a substantially vertical position.

10. The shallow water anchor of claim 9 wherein said substantially vertical disk is at least partially disposed within a housing including a wall and said anchor alignment comprises a groove including an inner surface formed on said wall of said housing such that said outer surface of said upper elongated element of said anchor member engages said inner surface of said groove of said anchor alignment and said inner surface of said groove of said substantially vertical disk to maintain said anchor member in the substantially vertical position.

11. The shallow water anchor of claim 10 further comprises an upper anchor alignment comprising a hollow sleeve coaxially aligned with the geometric center cooperatively formed between said inner surface of said groove of said substantially vertical disk and said inner surface of said groove of said wall of said housing to receive said upper elongated element of said anchor member to further maintain said member in the substantially vertical position.

12. The shallow water anchor of claim 9 wherein said an anchor alignment comprises a rotatably substantially vertical disk including a groove having an inner surface formed in the peripheral edge or circumference thereof to operatively engage said outer surface of said anchor member opposite said outer surface of said anchor member engaged by said inner surface of said groove of said substantially vertical disk of said anchor engaging member.

13. The shallow water anchor of claim 12 further comprises an upper anchor alignment comprising a hollow sleeve coaxially aligned with the geometric center cooperatively formed between said inner surface of said groove of said substantially vertical disk and said inner surface of said groove of said wall of said housing to receive said upper elongated element of said anchor member to further maintain said member in the substantially vertical position.

14. The shallow water anchor of claim 1 wherein said anchor engaging member comprises a substantially vertical disk having a plurality of teeth or projections formed on a peripheral edge or circumference thereof to operatively engage a plurality of teeth or projections formed on said outer surface of said anchor member.

15. The shallow water anchor of claim 14 further comprising an anchor alignment to engage said outer surface of said anchor member opposite said plurality of teeth or projections to maintain said anchor member in the substantially vertical position.

16. The shallow water anchor of claim 15 wherein said substantially vertical disk is at least partially disposed within a housing including a wall and said anchor alignment comprises a groove including an inner surface formed on said wall of said housing such that said outer surface of said upper elongated element of said anchor member engages said inner surface of said anchor alignment and said inner surface of said groove of said groove of said substantially vertical disk to maintain said anchor member in the substantially vertical position.

17. The shallow water anchor of claim 1 wherein said anchor positioning assembly is at least partially disposed within a housing.

18. The shallow water anchor of claim 1 wherein each said anchor engaging member comprises a disk having a groove including an inner surface formed in the peripheral edge or circumference thereof to at least partially receive said anchor member therein.

19. The shallow water anchor of claim 18 wherein each said groove comprises a rectilinear configuration including a substantially flat inner surface to engage said outer surface of said anchor member.

20. The shallow water anchor of claim 18 wherein each said groove comprises a concave configuration including a substantially concave inner surface to engage said outer surface of said anchor member.

21. The shallow water anchor of claim 18 further includes a resilient tread disposed within said groove of each said anchor engaging member.

22. The shallow water anchor of claim 21 wherein said resilient tread includes a V-shaped design to operatively engage said outer surface of said anchor member.

23. The shallow water anchor of claim 21 wherein said anchor member includes an upper elongated portion and lower blunt substantially convex tip.

24. The shallow water anchor of claim 23 wherein the horizontal distance between said resilient treads is less than the diameter of said upper elongated portion of said anchor member to grasp or squeeze said anchor member therebetween.

25. The shallow water anchor of claim 18 wherein the horizontal distance between said inner surfaces of said grooves is less than the diameter of said anchor member and said anchor member is compressible such that said anchor member is grasped or squeezed therebetween.

26. The shallow water anchor of claim 1 further includes an upper anchor member guide including a guide hole having an inner surface formed therethrough and a lower anchor member including a guide hole having an inner surface formed therethrough mounted to or supported within said upper housing portion and a lower housing extension formed on said lower housing portion respectively such that said anchor member extends through said guide holes and said outer surface of said anchor member engages said inner surfaces of said guide holes to maintain substantially vertical alignment of said anchor member.

27. The shallow water anchor of claim 1 including an input control device to control said anchor positioning drive or drive mechanism to selectively raise or lower said anchor member.

28. The shallow water anchor of claim 1 further including a system control to control the operation of the anchor position assembly to selectively raise and lower said anchor member, said system control comprises a microcontroller and input system controls to control the operation of said anchor positioning device or drive mechanism to selectively raise or lower said anchor member.

29. The shallow water anchor of claim 28 including at least an anchor position sensor assembly coupled to said microcontroller to generate a sensor signal fed to said microcontroller when said anchor member reaches a predetermined position during the raising or lower thereof and said microcontroller generates a control signal fed to said reversible motor to stop said reversible motor.

30. The shallow water anchor of claim 29 wherein said anchor position sensor assembly comprises a lower anchor member position sensor coupled to said microcontroller and a lower anchor member position sensing element coupled or mounted to said anchor member such that when in proximity relative to each other said lower anchor member position sensor element generates said sensor signal.

31. The shallow water anchor of claim 30 further including a second anchor system sensor assembly comprising an upper anchor member sensor coupled to said microprocessor and an upper anchor member positioning sensor element coupled or mounted to said anchor member such that when in proximity relative to end other said upper anchor member position sensor element generate said sensor signal.

32. The shallow water anchor of claim 29 wherein said anchor position sensor assembly comprises an upper anchor member sensor coupled to said microprocessor and an upper anchor member positioning sensor element coupled or mounted to said anchor member such that when in proximity relative to end other said upper anchor member position sensor element generate said sensor signal.

33. A shallow water anchor to anchor a water craft in a shallow body of water comprising an anchor positioning assembly mounted on or to the water craft and an anchor member including an outer surface, said anchor position assembly comprises at least one anchor engaging member coupled to an anchor positioning device or drive mechanism to raise and lower said anchor member such that said anchor member is lowered to engage the bottom of the shallow body of water to anchor the water craft and said anchor member is raised to disengage the bottom of the shallow body of water to permit the water craft to move about the shallow body of water, said anchor positioning assembly comprises an anchor engaging assembly including a pair of counter-rotating anchor engaging members rotatably disposed within said housing and operatively coupled to said anchor positioning device or drive mechanism including a reversible motor disposed within said housing and a gear drive assembly disposed within said housing portion to cooperatively raise and lower said anchor member and further including a free floating disk squeegee or wiper member movably disposed within a recess formed in said housing to wipe said outer surface of said anchor member during the raising and lowering of said anchor member.

34. The shallow water anchor of claim 33 wherein said free floating disk squeegee or wiper member includes a substantially horizontal groove formed on the outer vertical surface thereof and an inverted frustum conical hole formed through the center portion thereof aligned with said guide hole formed through said upper anchor member guide and said guide hole formed through said lower anchor member guide to receive said anchor member therethrough.

35. The shallow water anchor of claim 34 wherein the diameter of said lower circumference of said inverted frustum conical hole is slightly greater than the diameter of said anchor member and the diameter of said upper circumference of said inverted frustum conical hole is greater than that of the diameter of said anchor member.

36. A shallow water anchor to anchor a water craft in a shallow body of water comprising an anchor positioning assembly mounted on or to the water craft and an anchor member including an outer surface, said anchor positioning assembly comprises an anchor engaging assembly including a pair of counter-rotating anchor engaging members rotatably coupled to an anchor positioning device or drive mechanism including a reversible motor and a gear drive assembly to cooperatively raise and lower said anchor member such that said anchor member is lowered to engage the bottom of the shallow body of water to anchor the water craft and said anchor member is raised to disengage the bottom of the shallow body of water to permit the water craft to move about the shallow body of water and further including a system control to control the operation of the anchor position assembly to selectively raise and lower said anchor member, said system control comprises a microcontroller and input system controls to control the operation of said anchor positioning device or drive mechanism to selectively raise or lower said anchor member wherein said system control further including a current sensor coupled to said microcontroller to monitor motor current of said reversible motor and to generate a current signal fed to said microcontroller when said anchor member engages the bottom of the shallow body of water and said microcontroller generates a control signal fed to said reversible motor in response to said current signal to stop said reversible motor to anchor the water craft in position wherein said system control further includes a micro-electromechanical sensor coupled to said microcontroller to sense a change in attitude of the water craft and to generate a signal fed to said microcontroller to generate a control signal fed to said reversible motor to lower said anchor member to re-establish anchor on the bottom of the shallow body of water.

37. The shallow water anchor of claim 36 wherein the current sensor monitors motor current to generate a second current signal fed to said microcontroller when said anchor member passes through said anchor engaging members traveling upward when said reversible motor is operating to raise said anchor member to the reverse direction of said reversible motor to lower said anchor member until said upper anchor member position sensor and said upper anchor member position sensing element are in proximity relative to each other to stop said reversible motor with said anchor member in the raised position.

38. The shallow water anchor of claim 36 wherein said system control further includes a micro-electromechanical sensor coupled to said microcontroller to sense a change in orientation of the water craft and to generate a signal fed to said microcontroller to generate a control signal fed to said reversible motor to lower said anchor member to re-establish anchor on the bottom of the shallow body of water.

39. The shallow water anchor of claim 38 wherein said system control further includes a micro-electromechanical sensor coupled to said microcontroller to sense a change in global position of the water craft and to generate a signal fed to said microcontroller to generate a control signal fed to said reversible motor to lower said anchor member to re-establish anchor on the bottom of the shallow body of water.

40. The shallow water anchor of claim 36 wherein said system control further includes a micro-electromechanical sensor coupled to said microcontroller to sense a change in global position of the water craft and to generate a signal fed to said microcontroller to generate a control signal fed to said reversible motor to lower said anchor member to re-establish anchor on the bottom of the shallow body of water.

41. The shallow water anchor of claim 40 wherein said system control further includes a micro-electromechanical sensor coupled to said microcontroller to sense a change in orientation of the water craft and to generate a signal fed to said microcontroller to generate a control signal fed to said reversible motor to lower said anchor member to re-establish anchor on the bottom of the shallow body of water.

42. The shallow water anchor of claim 36 wherein said system control further includes a micro-electromechanical sensor coupled to said microcontroller to sense a change in orientation of the water craft and to generate a signal fed to said microcontroller to generate a control signal fed to said reversible motor to lower said anchor member to re-establish anchor on the bottom of the shallow body of water.

43. A shallow water anchor to anchor a water craft in a shallow body of water comprising an anchor positioning assembly mounted on or to the water craft and an anchor member including an outer surface, said anchor position assembly comprises at least one anchor engaging member coupled to an anchor positioning device or drive mechanism to raise and lower said anchor member such that said anchor member is lowered to engage the bottom of the shallow body of water to anchor the water craft and said anchor member is raised to disengage the bottom of the shallow body of water to permit the water craft to move about the shallow body of water, a system control to control the operation of the anchor position assembly to selectively raise and lower said anchor member, said system control comprises a microcontroller and input system controls to control the operation of said anchor positioning device or drive mechanism to selectively raise or lower said anchor member, said system control further includes a current sensor coupled to said microcontroller to monitor motor current of said reversible motor and to generate a current signal fed to said microcontroller when said anchor member engages the bottom of the shallow body of water and said microcontroller generates a control signal fed to said reversible motor in response to said current signal to stop said reversible motor to anchor the water craft in position and a micro-electromechanical sensor coupled to said microcontroller to sense a change in attitude of the water craft and to generate a signal fed to said microcontroller to generate a control signal fed to said reversible motor to lower said anchor member to re-establish an anchor position on the bottom of the shallow body of water.

44. The shallow water anchor of claim 43 including at least an anchor position sensor assembly coupled to said microcontroller to generate a sensor signal fed to said microcontroller when said anchor member reaches a predetermined position during the raising or lower thereof and said microcontroller generate a control signal fed to said reversible motor to stop said reversible motor.

45. The shallow water anchor of claim 44 wherein said anchor position sensor assembly comprises a lower anchor member position sensor coupled to said microcontroller and a lower anchor member position sensing element coupled or mounted to said anchor member such that when in proximity relative to each other said lower anchor member position sensor element generates said sensor signal.

46. The shallow water anchor of claim 45 further including a second anchor system sensor assembly comprising an upper anchor member sensor coupled to said microprocessor and an upper anchor member positioning sensor element coupled or mounted to said anchor member such that when in proximity relative to end other said upper anchor member position sensor element generate said sensor signal.

47. The shallow water anchor of claim 44 wherein said anchor position sensor assembly comprises an upper anchor member sensor coupled to said microprocessor and an upper anchor member positioning sensor element coupled or mounted to said anchor member such that when in proximity relative to end other said upper anchor member position sensor element generate said sensor signal.

48. The shallow water anchor of claim 43 wherein said system control further includes a micro-electromechanical sensor coupled to said microcontroller to sense a change in orientation of the water craft and to generate a signal fed to said microcontroller to generate a control signal fed to said reversible motor to lower said anchor member to re-establish anchor on the bottom of the shallow body of water.

49. The shallow water anchor of claim 48 wherein said system control further includes a micro-electromechanical sensor coupled to said microcontroller to sense a change in global position of the water craft and to generate a signal fed to said microcontroller to generate a control signal fed to said reversible motor to lower said anchor member to re-establish anchor on the bottom of the shallow body of water.

50. The shallow water anchor of claim 43 wherein said system control further includes a micro-electromechanical sensor coupled to said microcontroller to sense a change in global position of the water craft and to generate a signal fed to said microcontroller to generate a control signal fed to said reversible motor to lower said anchor member to re-establish anchor on the bottom of the shallow body of water.

51. The shallow water anchor of claim 50 wherein said system control further includes a micro-electromechanical sensor coupled to said microcontroller to sense a change in orientation of the water craft and to generate a signal fed to said microcontroller to generate a control signal fed to said reversible motor to lower said anchor member to re-establish anchor on the bottom of the shallow body of water.

52. The shallow water anchor of claim 43 wherein said system control further includes a micro-electromechanical sensor coupled to said microcontroller to sense a change in orientation of the water craft and to generate a signal fed to said microcontroller to generate a control signal fed to said reversible motor to lower said anchor member to re-establish anchor on the bottom of the shallow body of water.

53. A shallow water anchor to anchor a water craft in a shallow body of water comprising an anchor positioning assembly mounted on or to the water craft and an anchor member including an outer surface, said anchor position assembly comprises at least one anchor engaging member coupled to an anchor positioning device or drive mechanism to raise and lower said anchor member such that said anchor member is lowered to engage the bottom of the shallow body of water to anchor the water craft and said anchor member is raised to disengage the bottom of the shallow body of water to permit the water craft to move about the shallow body of water, a system control to control the operation of the anchor position assembly to selectively raise and lower said anchor member, said system control comprises a microcontroller and input system controls to control the operation of said anchor positioning device or drive mechanism to selectively raise or lower said anchor member and at least an anchor position sensor assembly coupled to said microcontroller to generate a sensor signal fed to said microcontroller when said anchor member reaches a predetermined position during the raising or lower thereof and said microcontroller generates a control signal fed to said reversible motor to stop said reversible motor, said anchor position sensor assembly comprises a lower anchor member position sensor coupled to said microcontroller and a lower anchor member position sensing element coupled or mounted to said anchor member such that when in proximity relative to each other said lower anchor member position sensor element generates said sensor signal and an upper anchor position sensing element coupled or mounted to said anchor member to generate a sensor signal when said anchor member reaches an upper limit to stop said reverse motor.

* * * * *